US009664055B2

(12) United States Patent
Yagi et al.

(10) Patent No.: US 9,664,055 B2
(45) Date of Patent: May 30, 2017

(54) IMPELLER AND ROTARY MACHINE PROVIDED WITH THE SAME

(71) Applicants: MITSUBISHI HEAVY INDUSTRIES, LTD., Tokyo (JP); MITSUBISHI HEAVY INDUSTRIES COMPRESSOR CORPORATION, Tokyo (JP)

(72) Inventors: Nobuyori Yagi, Tokyo (JP); Katsuya Yamashita, Tokyo (JP); Akihiro Nakaniwa, Tokyo (JP); Atsushi Higashio, Hiroshima (JP)

(73) Assignees: MITSUBISHI INDUSTRIES, LTD., Tokyo (JP); MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 626 days.

(21) Appl. No.: 14/114,584

(22) PCT Filed: Dec. 25, 2012

(86) PCT No.: PCT/JP2012/083427
§ 371 (c)(1),
(2) Date: Oct. 29, 2013

(87) PCT Pub. No.: WO2013/099846
PCT Pub. Date: Jul. 4, 2013

(65) Prior Publication Data

US 2014/0064975 A1 Mar. 6, 2014

(30) Foreign Application Priority Data

Dec. 26, 2011 (JP) ..... 2011-283953

(51) Int. Cl.
*F01D 5/30* (2006.01)
*F04D 29/20* (2006.01)
(Continued)

(52) U.S. Cl.
CPC ..... *F01D 5/30* (2013.01); *F04D 29/266* (2013.01); *F04D 29/284* (2013.01); *F04D 29/624* (2013.01)

(58) Field of Classification Search
CPC ..... F04D 29/266; F04D 29/624; F04D 29/20
See application file for complete search history.

(56) References Cited

U.S. PATENT DOCUMENTS 2,438,866 A 3/1948 Rockwell et al.
2,613,609 A * 10/1952 Buchi ..... F01D 5/025 416/186 R
(Continued)

FOREIGN PATENT DOCUMENTS

CN 2069501 1/1991
CN 1300350 6/2001
(Continued)

OTHER PUBLICATIONS

International Search Report issued Mar. 12, 2013 in International (PCT) Application No. PCT/JP2012/083427 with English Translation.
(Continued)

*Primary Examiner* — Christopher Verdier
*Assistant Examiner* — Brian O Peters
(74) *Attorney, Agent, or Firm* — Wenderoth, Lind & Ponack, L.L.P.

(57) ABSTRACT

An impeller and a rotary machine include an inner diameter portion, a disk portion, a blade portion, and a cover portion. The disk portion includes a main body portion adjacent to the blade portion, and a fixing portion disposed at a radially inward side of the main body portion and fitted at a radially outward side of an outer peripheral surface of the inner
(Continued)

diameter portion. The fixing portion is formed so as to protrude from the main body portion toward another side in an axial direction.

4 Claims, 11 Drawing Sheets

(51) Int. Cl.

| | |
|---|---|
| ***F04D 29/62*** | (2006.01) |
| ***F04D 29/26*** | (2006.01) |
| ***F04D 29/28*** | (2006.01) |

(56) References Cited

U.S. PATENT DOCUMENTS

| | | | | |
|---|---|---|---|---|
| 2,799,445 | A | 7/1957 | Hull | |
| 4,173,429 | A | 11/1979 | Hoffman et al. | |
| 4,183,719 | A | 1/1980 | Bozung | |
| 4,220,372 | A | 9/1980 | Johansen et al. | |
| 4,231,706 | A | 11/1980 | Ueda et al. | |
| 4,602,411 | A | 7/1986 | Brown | |
| 4,697,987 | A | 10/1987 | Katayama et al. | |
| 4,795,311 | A | 1/1989 | Arkhipov et al. | |
| 4,986,736 | A * | 1/1991 | Kajiwara | F04D 29/2227 403/259 |
| 6,481,970 | B2 | 11/2002 | Mukherjee et al. | |
| 7,341,430 | B2 | 3/2008 | Sano et al. | |
| 2010/0008775 | A1 | 1/2010 | Vedsted et al. | |
| 2010/0037458 | A1 | 2/2010 | Ranz et al. | |
| 2010/0189568 | A1 | 7/2010 | Watanabe et al. | |
| 2011/0200439 | A1 | 8/2011 | Nakaniwa et al. | |
| 2013/0272895 | A1 * | 10/2013 | Nakaniwa | B23P 15/006 416/241 R |

FOREIGN PATENT DOCUMENTS

| | | |
|---|---|---|
| CN | 2763589 | 3/2006 |
| CN | 101255871 | 9/2008 |
| CN | 205117803 | 3/2016 |
| DE | 755198 | 11/1952 |
| DE | 44 27 115 | 4/1995 |
| DE | 10 2009 031 7 | 7/2011 |
| EP | 0 283 825 | 7/1992 |
| FR | 1471604 | 3/1967 |
| JP | 55-4376 | 1/1980 |
| JP | 55-5456 | 1/1980 |
| JP | 58-72491 | 5/1983 |
| JP | 61-142393 | 6/1986 |
| JP | 61-212601 | 9/1986 |
| JP | 4-31695 | 2/1992 |
| JP | 2788818 | 8/1998 |
| JP | 2001-355595 | 12/2001 |
| JP | 2002-235694 | 8/2002 |
| JP | 2003-293988 | 10/2003 |
| JP | 2004-036444 | 2/2004 |
| JP | 2004-60460 | 2/2004 |
| JP | 2004-308647 | 11/2004 |
| JP | 2008-223540 | 9/2008 |
| JP | 2009-156122 | 7/2009 |
| JP | 4428044 | 3/2010 |
| JP | 2010-230012 | 10/2010 |
| JP | 2010-285919 | 12/2010 |
| JP | 2012-172645 | 9/2012 |
| JP | 2013-139753 | 7/2013 |

OTHER PUBLICATIONS

Written Opinion of the International Searching Authority issued Mar. 12, 2013 in International (PCT) Application No. PCT/JP2012/083427 with English Translation.

Chinese Office Action issued May 29, 2015 in corresponding Chinese Patent Application No. 201280019373.2 with English translation.

Extended European Search Report issued May 18, 2015 in corresponding European Patent Application No. 12861319.7.

Yuxin Cai, "Improvement in Process of Manufacturing an Impeller for a Centrifugal Drum Pressure Fan," Mechanical and Electrical Engineering Technology, No. 4, pp. 58-60, Aug. 30, 2001.

International Search Report issued Mar. 19, 2012 in corresponding International Application No. PCT/JP2011/078790, with English translation.

Written Opinion of the International Searching Authority issued Mar. 19, 2012 in corresponding International Application No. PCT/JP2011/078790, with English translation.

International Search Report issued May 22, 2012 in corresponding International Application No. PCT/JP2012/053783 with English translation.

Written Opinion of the International Searching Authority issued May 22, 2012 in corresponding International Application No. PCT/JP2012/053783 with English translation.

First Office Action issued Jan. 6, 2015 in corresponding Chinese Application No. 201180036597.X, with English translation.

Extended European Search Report issued Jul. 24, 2015 in corresponding European Application No. 11869760.6.

Office Action issued Nov. 3, 2015 in corresponding U.S. Appl. No. 13/812,617.

Office Action issued Jan. 26, 2016 in corresponding U.S. Appl. No. 13/976,108.

Final Office Action issued Apr. 29, 2016 in corresponding U.S. Appl. No. 13/812,617.

Final Office Action issued Nov. 15, 2016 in corresponding U.S. Appl. No. 13/812,617.

Final Office Action issued Jul. 27, 2016 in corresponding U.S. Appl. No. 13/976,108.

Notice of Allowance issued Nov. 18, 2016 in corresponding U.S. Appl. No. 13/976,108.

Decision to Grant a European Patent issued Mar. 9, 2017 in corresponding European Application No. 12861319.7.

* cited by examiner

IMPELLER AND ROTARY MACHINE PROVIDED WITH THE SAME

TECHNICAL FIELD

The present invention is related to an impeller and a rotary machine provided with the impeller fixed to a rotation axis thereof.

Priority is claimed from Japanese Patent Application No. 2011-283953, filed Dec. 26, 2011, the contents of which are incorporated herein by reference.

BACKGROUND ART

The rotary machine used for an industrial compressor, a turbo refrigerator, a small gas turbine and the like, comprises an impeller provided with a plurality of blades on a disk fixed to a rotation shaft of the rotor. The rotary machine provides pressure energy and velocity energy to a gas by rotating the impeller.

As the above-described impeller, a so-called closed-impeller in which a cover is integrally fixed to blades is known. In a case where this closed-impeller is produced as a single-piece product, like, for example, Japanese Unexamined Patent Application, First Publication No. 2009-156122, complex cutting and welding are required, and it takes time for an assembling work of the impeller.

In addition, Japanese Unexamined Patent Application, First Publication No. 2003-293988 shows a producing method of an impeller performing a diffusion bonding in such a way that flow passages between the blades, the flow passages being formed by an inner circumferential side part and an outer circumferential side part, are connected to each other. The impeller of Japanese Unexamined Patent Application, First Publication No. 2003-293988 has a value in access for machining tools in both the inner circumferential side part and the outer circumferential side part, but the flow passages are required to be formed in both of the inner circumferential side part and the outer circumferential side part, and the diffusion bonding is required to performed so as to communicate the flow passages with each other. Thus, this leads to an increase in production costs.

On the other hand, an impeller assembled on the rotation shaft by performing shrink fitting of an inner diameter portion formed on a base portion side of the disk is known. In a case of applying this impeller, since the disk portion having a relatively large thermal capacity is disposed in the vicinity of the inner diameter portion, the temperature of the inner diameter portion does not rise easily when the impeller is disassembled from the rotation axis by heating the inner diameter portion.

Therefore, for example as shown in FIG. 10, a portion extending in one side in a direction of an axis O (left side in FIG. 10) is formed at an inner diameter portion 420, and the inner diameter portion 420 is performed shrink fitting to be fitted on the rotation shaft at a position being spaced apart from disk portion 430 (the position of shrink fitting is shown by the thick line in FIG. 10). This allows achieving easily assembling and disassembling of the impeller to and from the rotation axis, because the shrink fitting can perform at the portion having a small thermal capacity.

However, since the inner diameter portion 420 is disposed below a blade portion 440 and a cover 450, the space below the blade portion 440 and the cover 450 becomes small, and, in particular, when the welding between the blade portion 440 and the disk portion 430 in the side of rotation shaft 5 and the welding between the blade portion 440 and the cover 450, a space S for using the tools cannot secure sufficiently. Thus, there is a possibility that variations occur on the quality of the finished product.

In addition, the materials forming the disk portion 430, the blade portion 440 and the cover portion 450, are limited to use materials having a good in welding property, because the disk portion 430, the blade portion 440 and the cover portion 450 is required to be joined by welding, or the like. Therefore, the degree of freedom in design is limited.

In contrast, to secure the space S and improve the degree of freedom in design, the structure for example as shown in FIG. 11 can be considered. The impeller 410 shown in FIG. 11 divides the disk portion 430 and the inner diameter portion 420 with a surface m along the axis O of the rotation shaft 5, and is formed in a single-piece by the disk portion 430, the blade portion 440 and the cover portion 450. Then, the base portion of the disk portion 430 is mounted on the inner diameter portion 420 by shrink fitting. Accordingly, the disk portion 430, the blade portion 440 and the cover portion 450 do not necessarily need to be joined by welding, but when being joined by welding, the space for welding can be sufficiently secured.

Problems to be Solved by the Invention

In a case of the impeller shown in FIG. 11, the impeller is formed so as to divide the inner diameter portion 420 and the disk portion 430, and the disk portion 430 is fitted to inner diameter portion 420 by shrink fitting. In a case of performing shrink fitting, thermal shrinking occurs on the disk portion 430 after fitting. However, in the disk portion 430, the variations in shrinking in radial direction occur between one side in the direction of the axis O in which the blade portion 440 and the cover portion 450 are assembled and the other side in the direction of the axis O opposite to the one side. More specifically, at the one side in the direction of axis O of disk portion 430 in which the blade portion 440 and the cover portion 450 are provided, thermal shrinking occurs on the blade portion 440 and the cover portion 450 in a similar way. Thus, the thermal shrinking at the one side in the direction of the axis O of the disk portion 430 is bigger than the thermal shrinking at the other side in the direction of the axis thereof. Therefore, the one side in the direction of the axis O of the disk portion 430 deforms in the radial direction more than the other side in the direction of the axis O.

Accordingly, an edge portion of the disk portion 430 is pulled toward the blade portion 440 and the cover portion 450, the disk portion 430 bends toward the one side in the direction of the axis O, and the other side in the direction of the axis O opposite to the bending direction in the base portion of the disk portion 430 is forced to be elevated. The base portion of the disk portion 430 is elevated at the other side in the direction of the axis O, thereby, a gap between the disk portion 430 and the inner diameter portion 420 can occur.

In addition, when the impeller 410 rotates, a large centrifugal force is applied to the blade portion 440 and the cover portion 450 provided on the one side of the disk portion 430. Accordingly, the blade portion 440 and the cover portion 450 change their position toward the outside in the radial direction, and the disk portion 430 has a possibility to be tilted toward the gap. That is, as a result of a repeated action of starting and stopping rotation of the impeller 410, the loss in stability such as wobble of the impeller 410 has a possibility to be occurred.

Disclosure of the Invention

The present invention has been made in view of the above circumstances, the degree of freedom in design is improved in the disk portion, the blade portion and the cover portion, and the disk portion, the blade portion and the cover portion can be formed in a single-piece easily. Furthermore, the present invention provides an impeller which can prevent a gap from being created at the joining surface between the disk portion and the inner diameter portion caused by thermal deformation and it provides an impeller which can assemble and disassemble easily with respect to the rotation shaft, and the rotary machine providing the same.

Means for Solving the Problem

The invention adopts the following configurations in order to solve the above problems.

An aspect of an impeller related to the present invention includes: an inner diameter portion of which one side in an axial direction with respect to a rotation shaft rotating around the axis of the rotor is fitted at the outside of a rotor by thermal deformation; a disk portion fitted at the outside of the rotor by thermal deformation at the other side in the axial direction of the inner diameter; a blade portion protruding from a surface facing toward the one side in the axial direction of the disk portion; and a cover portion formed in a single-piece together with the blade portion and covering the blade portion from the one side in the axial direction, wherein the disk portion includes: a main body portion adjacent to the blade portion; and a fixing portion disposed at a radially inward side of the main body portion and fitted at the outside of an outer peripheral surface of the inner diameter portion, wherein the fixing portion protrudes from the main body portion toward the other side in the axial direction.

According to this configuration, the disk portion can be fitted at the outside of the inner diameter portion by the thermal deformation after forming the disk portion, the blade portion and the cover portion in a single-piece. Thus, the space for working at the time of forming in a single-piece the disk portion, the blade portion and the cover portion can secure sufficiently. Therefore, the working time can make short and the degree of freedom in design can improve, because the disk portion, the blade portion and the cover portion need not necessarily be joined by welding.

In addition, since the one side in the axial direction of the inner diameter portion is fitted at the outside of the rotation shaft by the thermal deformation, and the disk portion is fitted at the outside of the other side in the axial direction of the inner diameter portion by the thermal deformation, the position of fitting at the outside of the inner diameter is spaced apart from the disk portion having a large thermal capacity, and the thermal capacity at the position of fitting at the outside of the inner diameter can be small. Therefore, the impeller can assemble and disassemble easily by applying thermal deformation on the inner diameter portion at the time of maintenance, or the like.

In addition, when the disk portion is fitted at the outside of the inner diameter portion, even though the main body portion of the disk portion tries to deform toward the one side of the axial direction by being pulled toward the side of the blade portion and the cover portion by the thermal deformation, the main body portion is subjected to constraint of part of the fixing portion protruded toward the other side in the axial direction than the main body portion of the disk portion. Thus, the deformation of the disk portion and the fixing portion can be reduced. Furthermore, the above protruded part holds itself in a contacting state so as to contact with the outer circumferential surface of the inner diameter portion without following displacement of the main body portion. Thus, the other side in the axial direction of the fixing portion is prevented from being elevated, and a proper surface pressure can be secured in between the fixing portion and the inner diameter portion to fix the fixing portion to the inner diameter portion. Therefore, it is possible to prevent a gap from being created at the fitting surface between the disk portion and the inner diameter portion by the thermal deformation of the blade portion, the cover portion and the disk portion.

Furthermore, according to another aspect of the impeller related to the present invention, in the above impeller, a thickness in the radial direction of the fixing portion may be set larger than that of the inner diameter portion.

According to this configuration, the inner diameter portion is made thin and is made easy to fix to the rotation shaft by the thermal deformation, and the rigidity of the fixing portion can increase. Thus, the deformation of the fixing portion is suppressed and the surface pressure of the fitting surface between the inner diameter and the fixing portion can be uniformized.

Furthermore, according to another aspect of the impeller related to the present invention, in the above impeller, a recessed portion having an annular shape may be formed adjacent to the fixing portion at the other side in the axial direction of the main body portion.

According to this configuration, the size of the protruding portion which protrudes toward the other side in the axial direction of the fixing portion can further scale up its size with respect to the size along the axial direction of the main body portion adjacent to the fixing portion, without scaling up the size of the fixing portion along the axial direction. Thus, even though the main body portion tries to deform toward the one side in the axial direction, the elevation of the other side in the axial direction of the fixing portion caused by the deformation of the main body portion can reliably be prevented. Therefore, it is possible to prevent a gap from being created at the fitting surface between the disk portion and the inner diameter portion while suppressing an increase in size of the impeller.

Furthermore, according to another aspect of the impeller related to the present invention, in the above impeller, the inner diameter portion may provide a positioning portion in the axial direction of the disk portion.

According to this configuration, when the disk portion is fitted at the outside of the inner diameter portion, the disk portion can be positioning accurately with respect to the inner diameter portion. Therefore, variations of quality can be prevented.

Furthermore, according to another aspect of the impeller related to the present invention, in the above impeller, the positioning portion may provide a lightening portion at a contacting surface contacting a surface of the one side in the axial direction of the disk portion.

According to this configuration, since the positioning of the disk portion can be performed by the positioning portion and the positioning portion is formed by forming the lightening portion, the rigidity of the inner diameter portion at the part forming the positioning portion is prevented from partially increasing. Therefore, the inner diameter can deform smoothly so that the inner diameter follows the deformation of the disk portion.

Furthermore, according to another aspect of the impeller related to the present invention, in the above impeller, the inner diameter portion may form a cutting portion, which is chamfered, between the other side in the axial direction of the inner diameter and the outer peripheral surface.

According to this configuration, the length of the outer circumferential surface (mounting seating surface) of the rotation shaft at a thick portion of the inner diameter portion is shorter in the axial direction than the length of the inner circumferential surface of the fixing portion of the disk portion. In addition, the thickness of the thick portion is formed thinner than that of the fixing portion.

By reducing the rigidity of the thick portion partially by the cutting portion, the gap does not occur at the other side in the axial direction, the mounting seating surface and the inner circumferential surface are kept in parallel, and the mounting seating surface and the inner circumferential surface can easily fit closely to each other. Therefore, the surface pressure by the shrink fitting can be secured sufficiently.

In another aspect of the present invention, the rotary machine is provided with the above impeller.

According to this configuration, the maintenance of the impeller can be performed easily, and it can prevent wobble of the impeller at the time of rotation and prevent variations in quality thereof. Therefore, the quality of the product can be improved.

Effects of the Invention

According to the present invention, the degree of freedom in design is improved in the disk portion, the blade portion and the cover portion, and the disk portion, the blade portion and the cover portion can be formed in a single-piece easily. Furthermore, it can prevent a gap from being created at the joining surface between the disk portion and the inner diameter portion caused by thermal deformation, and it is possible to assemble and disassemble easily with respect to the rotation shaft.

EMBODIMENTS OF THE INVENTION

Figure 1:
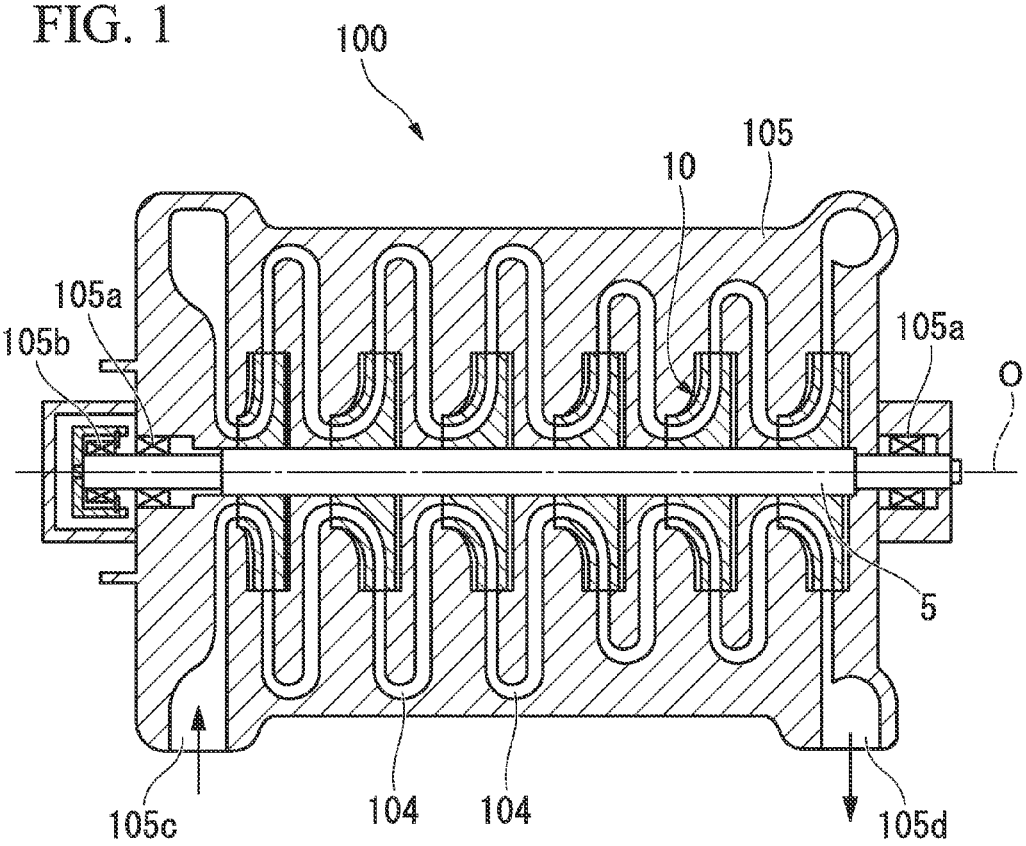
FIG. 1 is a vertical cross-sectional view of a centrifugal compressor having a rotary machine in the present invention.

Next, a rotary machine in the first embodiment of the present invention will be described with referring to the drawings.

FIG. 1 is a schematic drawing showing of schematic configuration of a centrifugal compressor 100 having a rotary machine in the present embodiment. As shown in FIG. 1, a rotary shaft 5 is supported pivotally via a journal bearing 105*a* and a thrust bearing 105*b* in the casing 105 of the centrifugal compressor 100. A plurality of impellers 10 is mounted on the rotary shaft 5 with arranging in a direction of an axis O. Each impeller 10 uses a centrifugal force generated by the rotation of the rotation shaft 5, compresses a gas in stages from an upstream side of a flowing-passage 104 formed on the casing 105 toward a downstream side of the flowing-passage 104, and allows the gas to flow.

In the casing 105, an inlet port 105*c* is formed at one side (left side in FIG. 1) in a direction of the axis O of the rotary shaft 5 and is configured to allow the gas to flow-in from the outside, and an outlet port 105*d* is formed at the other side (right side in FIG. 1) in the direction of the axis O and is configured to discharge the gas to the outside. That is, according to the above centrifugal compressor configuration, when the rotation shaft 5 rotates, the gas flows into the flowing passage 104 from the inlet port 105*c*, the gas is compressed in stages by the impellers 10, and the compressed gas is discharged to the outside from the outlet port 105*d*. In addition, one example providing six impellers 10 on the rotation shaft 5 arranged in series is shown in FIG. 1. However, at least one impeller 10 may be provided on the rotary shaft 5. The following description explains the case where one impeller 10 is provided on the rotary shaft 5 to simplify the description.

Figure 2:
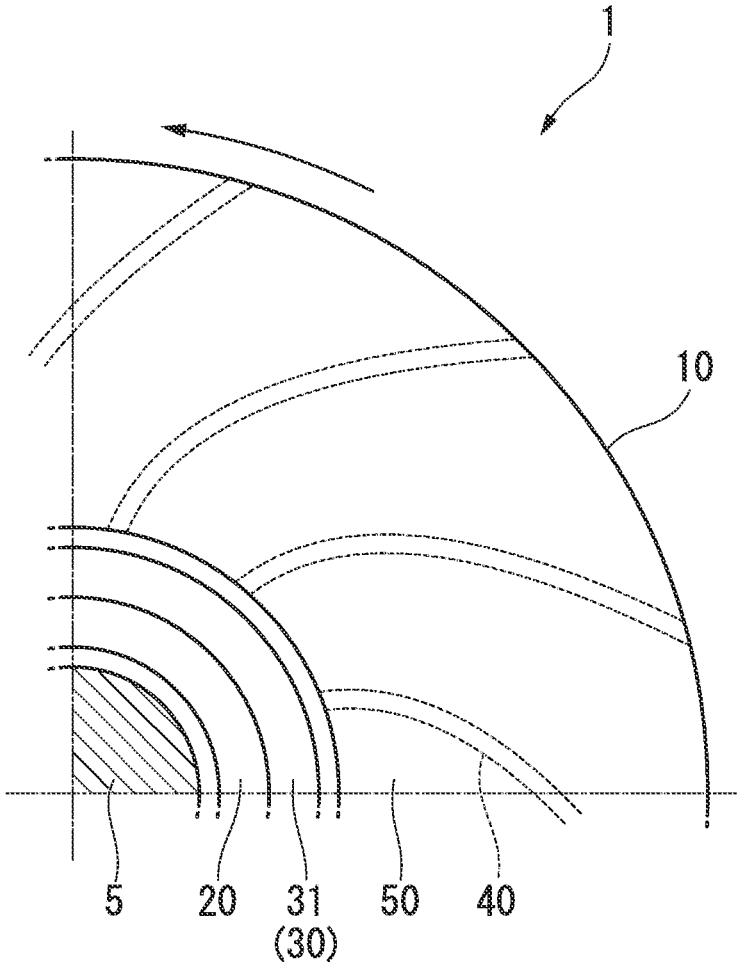
FIG. 2 is a front view of the rotary machine of the present invention.

As shown in FIG. 2, the impeller 10 of the rotary machine 1 is provided with an inner diameter portion 20, a disk portion 30, a plurality of blade portions 40, and a cover portion 50. The inner diameter portion 20 is fitted at the outside of the rotary shaft 5. The disk portion 30 is fitted at the outside of the inner diameter portion 20 and having substantially a disk-shape. The plurality of blade portions 40 is provided so as to protrude from a surface 31 of the one side in the direction of the axis O of the disk portion 30. The cover portion 50 is formed in a single-piece with respect to the blade portions 40, and is formed so as to cover the blade portions 40 from the one side in the direction of the axis O. The impeller 10 of the rotary machine 1 is a so-called closed-impeller which includes them.

Figure 3:
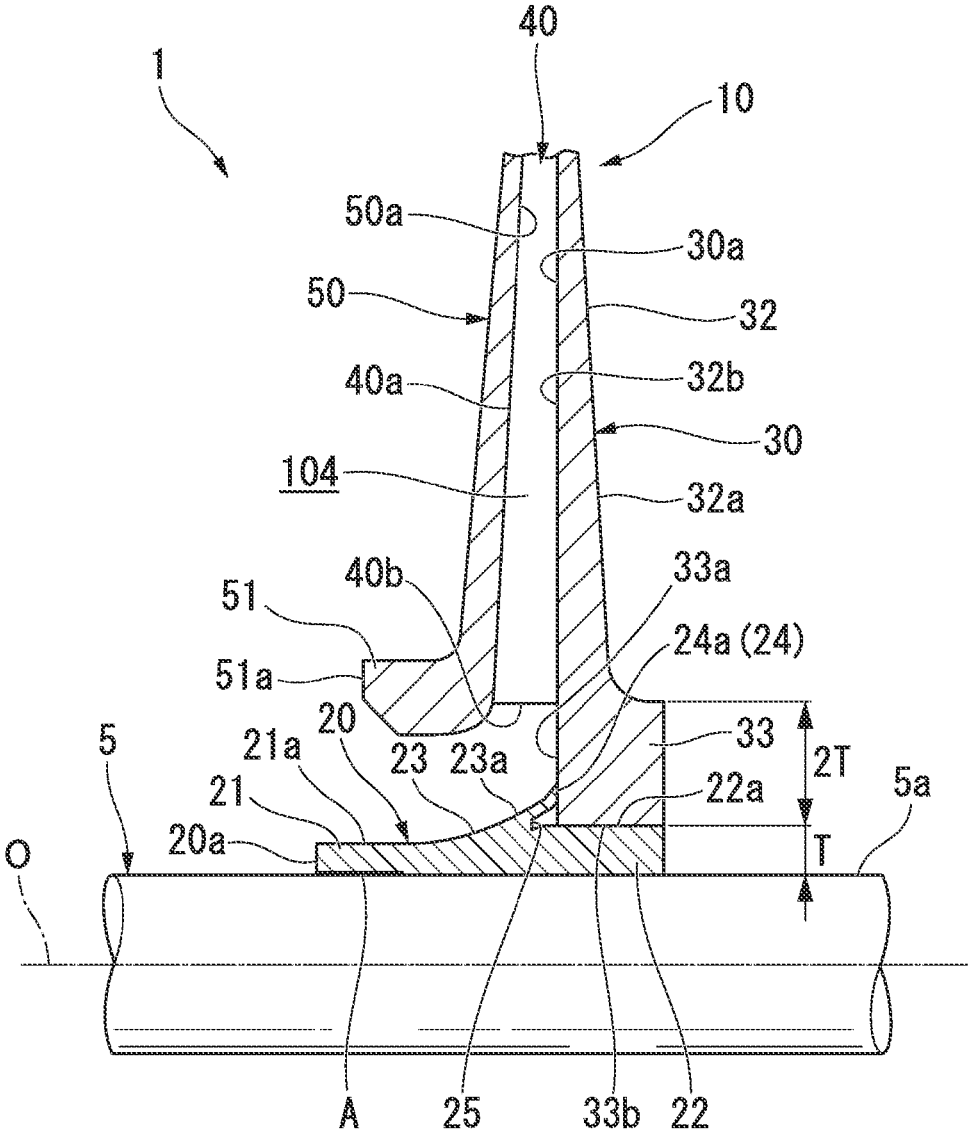
FIG. 3 is a vertical cross-sectional view of an impeller in the present invention.

With reference to FIGS. 2 and 3, the blade portions 40 are formed in a substantially constant thickness and are formed so as to protrude toward the one side in the direction of the axis O from the surface 31 of the one side of the disk portion 30. Furthermore, the blade portions 40 are arranged in a circumferential direction with equal intervals on the surface 31 of the one side of the disk portion 30. The blade portion 40, as seen from the direction of the axis O, is formed in a recessed shape so as to have a curve toward a rear direction of the rotation direction (shown in FIG. 2 with an arrow) of the rotation machine 1 and to the outward in a radial direction of the disk portion 30. In addition, the blade portion 40 has a slightly tapered shape toward outward in the radial direction as seen in a side view.

In addition, the description indicates the case where the blade portion 40 is formed in a curved shape as seen from the direction of the axis O. However, the blade portion 40 may be extended toward the rear side of the rotation direction and to the outward in the radial direction thereof and, for example, the blade portion 40 may be formed straight as seen from the direction of the axis O.

The inner diameter portion 20 has a substantially cylindrical shape centered at the axis O. The inner diameter portion 20 is provided with a thin portion 21, a thick portion 22, and an expanding diameter portion 23. The thin portion 21 is formed at the one side in the direction of the axis O. The thick portion 22 is formed at the other side in the direction of the axis O of the inner diameter portion 20. The expanding diameter portion 23 is formed between the thin portion 21 and the thick portion 22, and expands its diameter gradually toward the other side in the direction of the axis O.

A positioning portion 24, which is provided with a wall surface (contacting surface) 24*a* substantially perpendicular to the outer circumferential surface of rotation shaft 5, is formed between the expanding diameter portion 23 and the thick portion 22. The positioning portion 24 is in contact with a surface 33*a* of the one side of the fixing portion 33 of the disk portion 30 described as follows, and thereby, the fixing portion 33 of the disk portion 30 restricts displacement toward the one side of the direction of the axis O more than a predetermined fixing position.

Furthermore, a lightening portion 25, which reduces the rigidity of the inner diameter portion 20 in the positioning portion 24, is formed on the wall surface 24*a* of the positioning portion 24. By forming this lightening portion 25, the rigidity of the inner diameter portion 20 at the part in which the positioning portion 24 is formed can be made equivalent to the rigidity of the thick portion 22. Accordingly, the rigidity of the area close to the disk portion 30 of the inner diameter 20 can be uniformized rather than a case where the lightening portion 25 is not formed.

The thin portion 21 is formed relatively thinner than the above thick portion 22. In addition, the inner diameter of the thin portion 21 is made slightly smaller than the outer diameter of the rotation shaft 5, and the thin portion 21 is performed a shrink fitting with respect to the rotation shaft 5. By the shrink fitting at the thin portion 21, the inner diameter portion 20 is fitted with respect to the rotation shaft 5. In addition, the region A of the shrink fitting is shown with the thick line in FIG. 3.

The expanding diameter portion 23 is expanding in diameter toward the other side in the direction of the axis O, and thus, an outer circumferential surface 23*a* of the expanding diameter portion 23 has a curved shape raising toward the outward in the radial direction of the rotation shaft 5 toward the other side in the direction of the axis O. In addition, the above described positioning portion 24 is formed by molding having a step toward inner side in the radial direction at the other side in the direction of the axis O of the expanding diameter portion 23.

The thick portion 22 is formed at the other side in the direction of the axis O than the positioning portion 24. The thick portion 22 is formed relatively thicker than the thin portion 21. A mounting seating surface 22*a* is formed substantially in parallel with the outer circumferential surface 5*a* of the rotation shaft 5 in the outer circumferential surface of the thick portion 22. The disk portion 30 is fitted at the outside of this mounting surface 22*a*. The expanding diameter portion 23 and the thick portion 22 are not fitted at the outside of the rotation shaft 5, and thus, the expanding diameters of the inner diameter portion 23 and the thick portion 22 are formed the same as the outer diameter of the rotation shaft 5 or slightly larger than the outer diameter of the rotation shaft 5.

The disk portion 30 is provided with a main body portion 32 and a fixing portion 33. The main body portion 32 is arranged at the outer portion in the radial direction thereof. The fixing portion 33 is arranged at a radially inward side of the main body portion 32.

The main body portion 32 is formed in a slightly thin plate-shape in the thickness of the outer portion in the radial direction.

The thickness in the direction of the axis O of the fixing portion 33 is formed sufficiently larger (for example, approximately twice the length thereof) than the thickness of the base portion side of the above main body portion 32. The fixing portion 33 is positioned so as to protrude toward the other side in the direction of the axis O than the position of a surface 32*a* of the other side of the main body portion 32. Furthermore, the thickness in the radial direction of the fixing portion 33 is formed sufficiently thicker than the thickness of the thick portion 22 of the inner diameter portion 20. The thickness in the radial direction of the fixing portion 33 is, for example, approximately 2 T which is approximately twice the length of the thickness of the thick portion 22. By setting the thickness in the radial direction in this way, the rigidity of the fixing unit 33 is higher than the rigidity of the thick portion 22.

The inner circumferential surface 33*b* of the fixing portion 33 and the mounting seating surface 22*a* of the thick portion 22 are set approximately same in length in the direction of the axis O. In addition, the disk portion 30 is formed so that surfaces 32*b* and 33*a* of the one side in the direction of the axis O of the main body portion 32 and the fixing portion 33 are in a flat surface. The inner diameter of the fixing portion 33 is slightly smaller than the outer diameter of the above described mounting seating surface 22*a*, and the fixing portion 33 is fitted by shrink fitting with respect to the thick portion 22.

A surface 50*a* of the other side in the direction of the axis O of the cover portion 50 is mounted on an edge 40*a* of the one side of the blade portion 40. The thickness of the cover portion 50 is made in a slightly thin plate shape in the thickness of the outward in the radial direction as same as the thickness of the disk portion 30. The cover portion 50 is provided with a curved portion 51 which is curved toward the one side in the direction of the axis O in the position of an inner edge 40*b* of the blade portion 40.

The impeller 10 configured as above, the expanding diameter portion 23 is arranged at the inner side in the radial direction of the blade portion 40. In addition, the edge portion 20*a* of the inner diameter portion 20 is arranged at the one side in the direction of the axis O than an edge surface 51*a* of the curved portion 51. A flow passage 104 which allows the gas to flow is demarcated by the outer circumferential surface 21*a* of the thin portion 21, the outer circumferential surface 23*a* of the expanding diameter portion 23, the surface 30*a* of the one side of the disk portion 30, the wall surface of the blade portion 40 and the surface 50*a* of the other side of the cover portion 50.

Next, the method of assembling the above described rotary machine 1 is described.

First, the disk portion 30, the blade portion 40 and the cover portion 50 are formed in a single-piece by welding and cutting or the like.

After that, the inner circumferential surface 33*b* of the disk portion 30 is fitted by shrink fitting with facing the mounting seating surface 22*a* of the inner diameter portion 20. Accordingly, the assembling of the impeller 10 is completed.

Then, the inner diameter portion 20 is fitted by shrink fitting at the predetermined position of the outer circumferential surface 5*a* of the rotation shaft 5*a*.

Accordingly, the assembling of the rotary machine 1 is completed.

Figure 4:
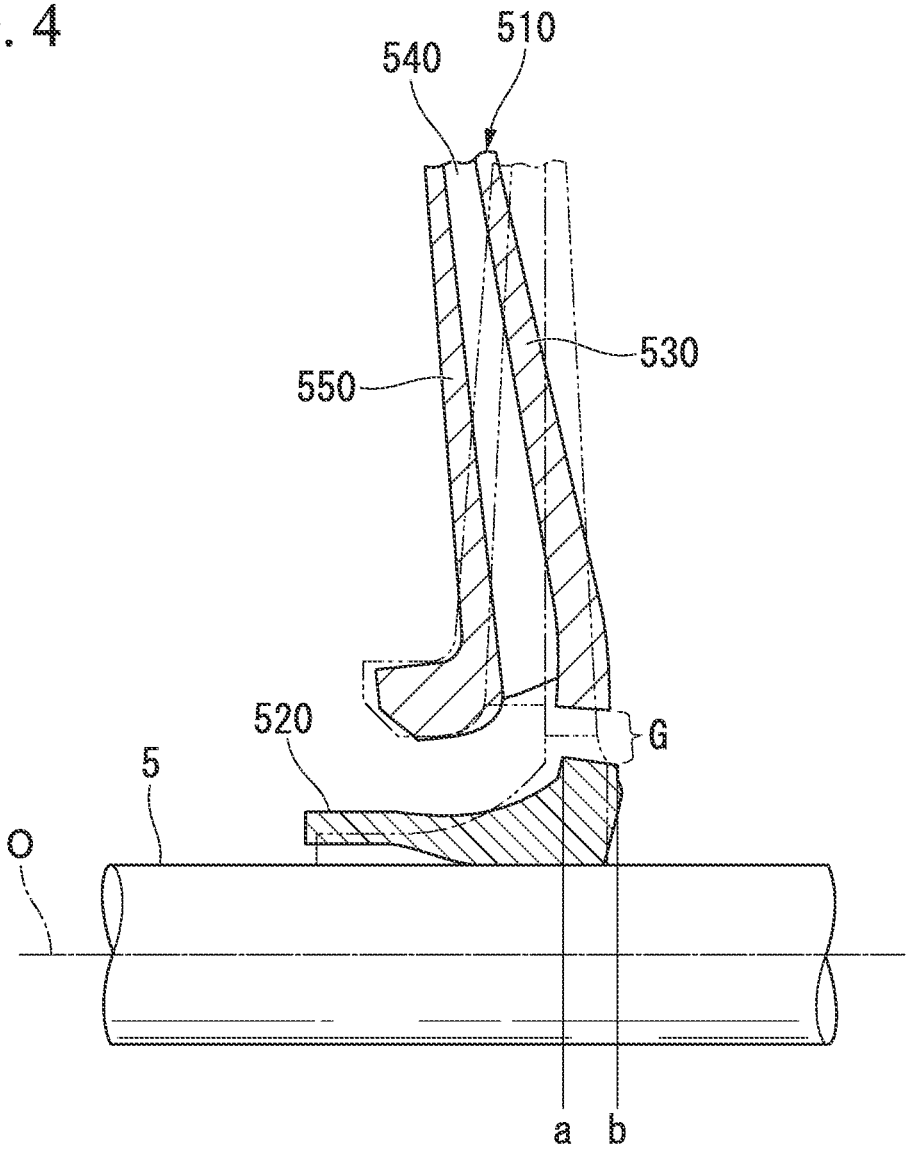
FIG. 4 is a vertical cross-sectional view of a conventional impeller in a deformation state.
Figure 5:
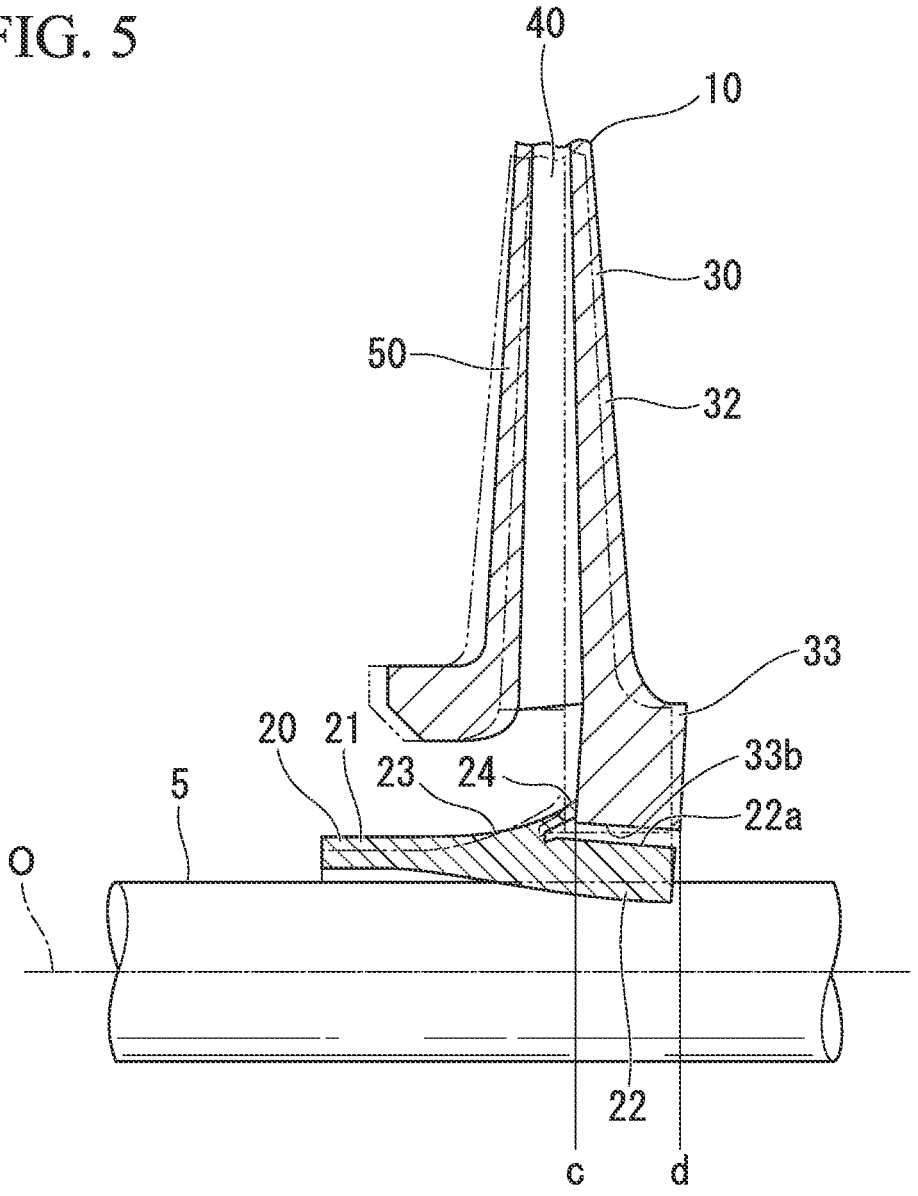
FIG. 5 is a vertical cross-sectional view of the impeller in the present invention which corresponds to FIG. 4.
Figure 6:
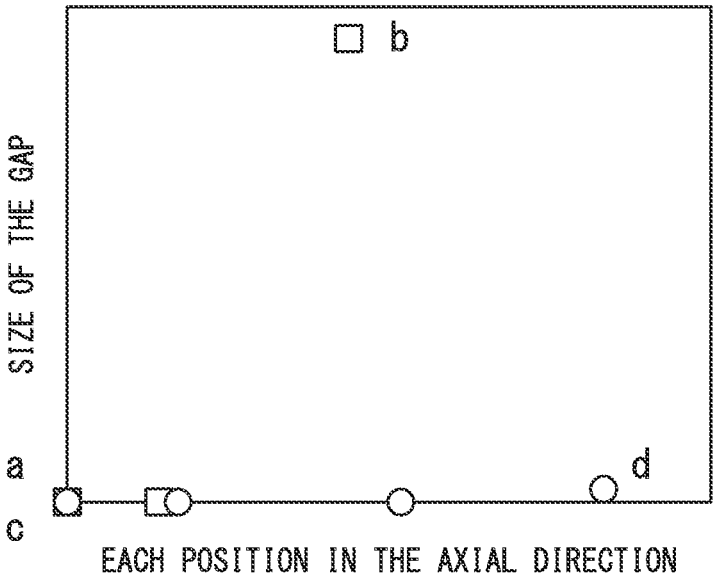
FIG. 6 is a graph showing changes of size of the gap with respect to each position in the axial direction of FIGS. 4 and 5.

Next, the deformations of the impeller 10 of the present embodiment and the conventional impeller 510 by shrink fitting are described with referring to the FIGS. 4 to 6. Here, FIG. 4 shows the case where the conventional impeller 510 is performed shrink fitting, and FIG. 5 shows the case where the impeller 10 in the above described present embodiment is performed shrink fitting. In addition, FIG. 6 shows the changes of the gap size between the disk portions 30, 530 and the inner diameter portions 20, 520 corresponding to each position in the direction of the axis O in FIGS. 4 and 5. The conventional impeller 510 shown in FIG. 4 is different from the impeller 10 of the present embodiment at a point of not providing the fixing portion 33 and the positioning portion 24. In addition, the position of the impeller before its deformation by the shrink fitting is shown by two-dot chain line in FIGS. 4 and 5. In addition, the displacement of each position of the impeller 10 by the shrink fitting is shown in an exaggerated way in FIGS. 4 and 5, and thus, it is not necessarily corresponding to the gap size shown in FIG. 6.

As shown in FIG. 4, in the conventional impeller 510, when the disk portion 530 is mounted on the inner diameter portion 520 by shrink fitting, the part of the outer side in the radial direction of the disk portion 530 is pulled toward the one side (left side in FIG. 4) in the direction of the axis O by the thermal shrinking of the blade portion 540 and the cover portion 550 and as a result it bends. In addition, the total rigidity of the blade portion 540 and the cover portion 550 is higher than the rigidity of the disk portion 530 (, and it is the same as in the impeller 10 of the present embodiment).

Accordingly, in a fitting portion G between the disk portion 530 and the inner diameter portion 520, the position b of the other side (right side in FIG. 4) in the direction of the axis O which is opposite to the bending side is elevated. In this way, the position b opposite to the bending side is elevated in the fitting portion G, and as a result, as shown in FIG. 6, a large gap is created at the fitting portion which is between the disk portion 530 and the inner diameter portion 520 in the position b in the direction of the axis O.

On the other hand, as shown in FIG. 5, according to the impeller 10 of the present embodiment, the fixing portion 33 of the disk portion 30 is formed so as to protrude to the other side in the direction of the axis O than the main body portion 32, and accordingly, the rigidity of the fixing portion 33 increases. Thus, the bending of the main body portion 32 is suppressed even though the fixing portion 33 is pulled toward the blade portion 40 and the cover portion 50. Furthermore, by setting the thickness of the fixing portion 33 sufficiently thicker than the thickness of the thick portion 22 in the radial direction, the rigidity of the fixing portion 33 exceeds the rigidity of the thick portion 22. Thus, the thick portion 22 deforms to follow the deformation of the fixing portion 33, and therefore, the inner circumferential surface 33*b* of the fixing portion 33 and the mounting seating surface 22*a* of the thick portion 22 is maintained in a substantially parallel state. As shown in FIG. 6, the gap between the inner circumferential surface 33*b* and the mounting seating surface 22*a* is hardly occurred in both the bending side c and the opposite side d in the direction of the axis O.

Therefore, according to the impeller 10 of the above described present embodiment, the fixing portion 33 of the disk portion 30 can be fitted at the outside of the thick portion 22 of the inner diameter portion 20 by the shrink fitting after forming the disk portion 30, the blade portion 40, and the cover portion 50 in a single-piece. Thus, the space for working at the time of forming in a single-piece the disk portion 30, the blade portion 40, and the cover portion 50 can secure sufficiently. As a result, the working time can be reduced and the degree of freedom in design can be improved, because the disk portion 30, the blade portion 40, and the cover portion 50 need not necessarily be joined by welding.

In addition, since the one side in the direction of the axis O of the inner diameter portion 20, that is, the thin portion 21, is fitted at the outside of the rotation shaft 5 by shrink fitting, and the disk portion 30 is fitted at the outside of the other side in the direction of the axis O of the inner diameter portion 20, that is, the thick portion 22, by the shrink fitting, the position of fitting at the outside of the inner diameter 20 is spaced apart from the disk portion 30 having a large thermal capacity, and the thermal capacity at the position of fitting at the outside of the inner diameter 20 can be small. As a result, the impeller 10 can be easily assembled to and disassembled from the rotation shaft 5 by applying thermal deformation on the thin portion 21 of the inner diameter portion 20 at the time of maintenance, or the like.

In addition, when the disk portion 30 is fitted at the outside of the inner diameter portion 20, even though the disk portion 30 tries to deform toward the one side of the direction of the axis O by being pulled toward the side of the blade portion 40 and the cover portion 50 by the thermal deformation, the disk portion 30 is subjected to constraint of a part of the fixing portion 33 protruded toward the other side in the direction of the axis O than the main body portion 32, and thus, the bending of the disk portion 30 can be reduced. Furthermore, the protruding part of the above fixing portion 33 holds itself in a contacting state so as to contact with the outer circumferential surface of the inner diameter portion 20 without following displacement of the main body portion 32. Thus, the other side in the direction of the axis O of the fixing portion 33 is prevented from being elevated, and a proper surface pressure can be secured at the fitting surface formed between the inner circumferential surface 33*b* of the fixing portion 33 and the mounting seating surface 22*a* of the thick portion 22 to fix the fixing portion 33 to the inner diameter portion 20. As a result, it is possible to prevent a gap from being created between the inner circumferential surface 33*b* of the disk portion 30 and the mounting seating surface 22*a* of the inner diameter portion 20 by the thermal deformation of the blade portion 40, the cover portion 50 and the disk portion 30.

Furthermore, the thickness of the fixing portion 33 is set larger than the thickness of the inner diameter portion 20, and accordingly, the inner diameter portion 20 is made thin and made easy to fix on the rotation shaft 5 by the thermal deformation, and the rigidity of the fixing portion 33 can increase. As a result, the deformation of the fixing portion 33 is suppressed and the surface pressure between the inner circumferential surface 33*b* and the mounting seating surface 22*a* can be uniformized.

In addition, since the inner diameter portion 20 is provided with the positioning portion 24 which set the position in the direction of the axis O of the disk portion 30, the disk portion 30 can be positioning accurately with respect to the inner diameter portion 20 when the disk portion 30 is fitted at the outside of the inner diameter portion 20. Therefore, variations of quality, such that steps are formed in the inner surface of the flow passage 104, and the like, can be suppressed.

Next, the impeller and the rotary machine providing the impeller in the second embodiment of the present invention are described with reference to the drawings. The impeller of this second embodiment is provided with a recessed portion having an annular shape adjacent to the fixing portion 33 with respect to the impeller 10 of the above described first embodiment. Thus, the same reference signs are used at the same parts of the above described first embodiment.

Figure 7:
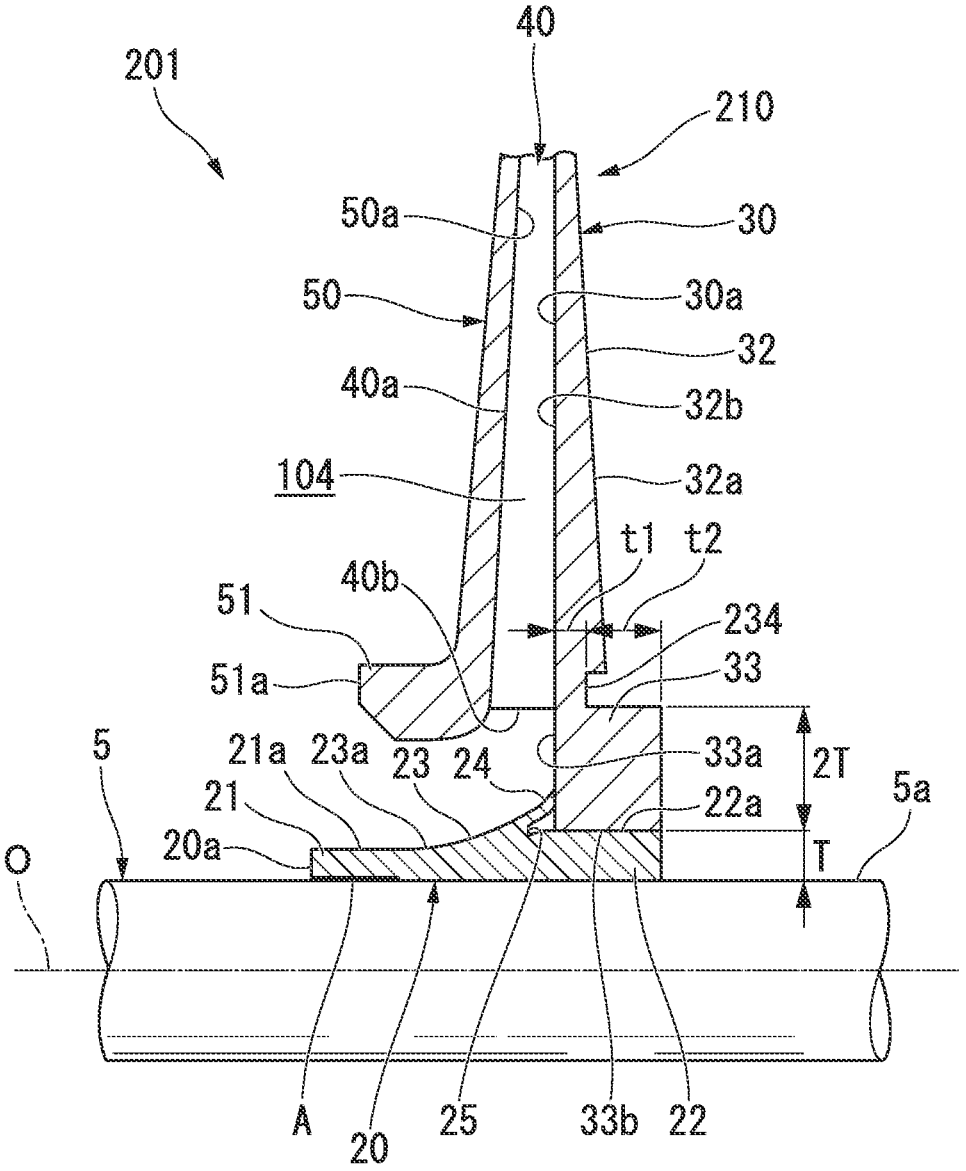
FIG. 7 is a vertical cross-sectional view of the impeller in the second embodiment of the present invention which corresponds to FIG. 3.

As shown in FIG. 7, in the rotary machine 201 according to the present embodiment, the impeller 210 is fitted at the outside of the rotation shaft 5 by the shrink fitting as same as the rotary machine 1 of the above described first embodiment.

The impeller 210 is provided with an inner diameter portion 20, a disk portion 30, a plurality of blade portions 40, and a cover portion 50. The inner diameter portion 20 is fitted at the outside of the rotary shaft 5. The disk portion 30 is fitted at the outside of the inner diameter portion 20 and has a disk-shape. The blade portions 40 are provided so as to protrude from a surface 30*a* of the one side in the direction of the axis O of this disk portion 30. The cover portion 50 is formed in a single-piece with respect to the blade portions 40, and is formed so as to cover the blade portions 40 from the one side in the direction of the axis O. In addition, the inner diameter portion 20, the blade portions 40, and a cover portion 50 are configured as the same as the above described first embodiment, and thus, the detail description thereof is omitted.

The disk portion 30 is provided with a main body portion 32 and a fixing portion 33. The main body portion 32 is arranged at the outer portion in the radial direction of the disk portion 30. The fixing portion 33 is arranged at a radially inward side of the main body portion 32.

A length along the direction of the axis O of the fixing portion 33 is formed sufficiently larger (for example, approximately twice the length thereof) than the length along the direction of the axis O of the base portion side of the main body portion 32 in the radial direction. The fixing portion 33 is positioned so as to protrude toward the other side in the direction of the axis O than the position of a surface 32*a* of the other side of the main body portion 32. Furthermore, the thickness in the radial direction of the fixing portion 33 is formed sufficiently thicker than the thickness of the thick portion 22 of the inner diameter portion 20. More specifically, the thickness in the radial direction of the fixing portion 33 is approximately 2 T which is approximately twice the length of the thickness of the thick portion 22.

The inner circumferential surface 33*b* of the fixing portion 33 and the mounting seating surface 22*a* of the thick portion 22 are set approximately same in length in the direction of the axis O. In addition, the disk portion 30 is formed so that surfaces 32*b* and 33*a* of the one side in the direction of the axis O of the main body portion 32 and the fixing portion 33 are in a flat surface. The inner diameter of the fixing portion 33 is slightly smaller than the outer diameter of the above described mounting seating surface 22*a*, and the fixing portion 33 is fitted at the outside of the thick portion 22 by the shrink fitting.

The main body portion 32 is formed in a substantially plate-shape and the thickness thereof becomes slightly thin to the outward in the radial direction.

A recessed portion 234 having substantially an annular shape around the axis O as a center is formed at the part adjacent to the fixing portion 33 (in other words, the base side of the main body portion 32) at the surface 32*a* of the other side in the direction of the axis O of the main body portion 32. The recessed portion 234 is formed in a square groove shape so as to hollow the surface 32*a* from the side of the surface 32*a* of the other side. The length along the direction of the axis O of the main body portion 32 is reduced at the amount of the part of which this recessed portion 234 is formed. The depth of this recessed portion 234 in the direction of the axis O is preferred to be set as deep as possible in scope of that the strength of the main body portion 32 can be obtained sufficiently. In addition, the recessed portion 234 may be cut from the other side in the direction of the axis O, but not limited to the above described square groove shape.

Therefore, according to the impeller 210 and the rotary machine 201 in the above described second embodiment, the recessed portion 234 adjacent to the fixing portion 33 and having an annular shape is formed at the surface 32*a* of the other side in the direction of the axis O of the main body portion 32, and accordingly, a length t2 of which the fixing portion 33 is protruded toward the other side can be relatively longer with respect to a length t1 along the direction of the axis O of the base portion of the main body portion 32 in the inner side of the radial direction of the main body portion 32, without making large the length along the direction of the axis O of the fixing portion 33.

As a result, it is possible to prevent a gap from being created between the disk portion 30 inner circumferential surface 33*b* and the inner circumferential surface 22*a* of the inner diameter portion 20 while suppressing of increasing in size of the impeller 210.

Next, the impeller 310 in the third embodiment of the present invention and the rotary machine 301 providing the impeller 310 are described. The impeller 310 of this third embodiment is different to the impeller 10 in the above described first embodiment at the point of the position of the fixing portion 33 and the shape of the thick portion 22 of the inner diameter portion 20. Thus, the same reference signs are used at the same part thereof.

Figure 8:
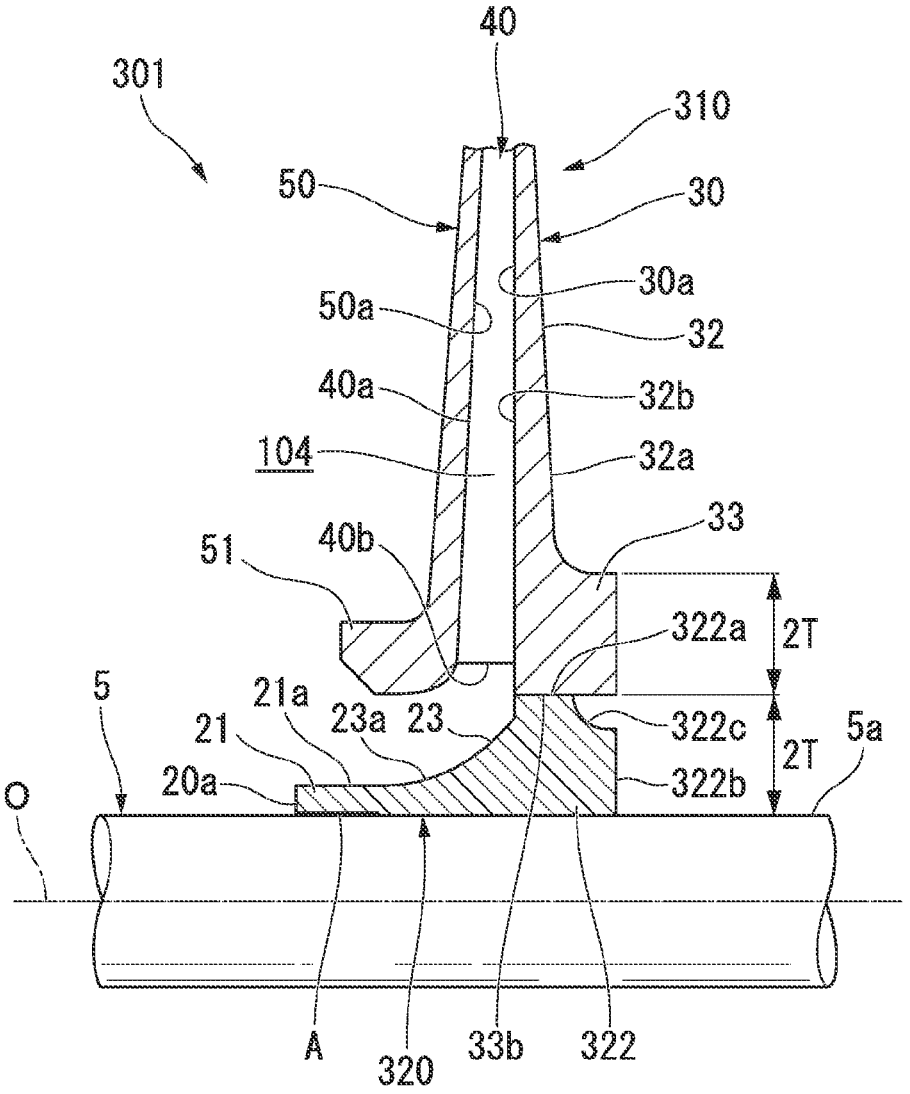
FIG. 8 is a vertical cross-sectional view of the impeller in the third embodiment of the present invention which corresponds to FIG. 3.

As shown in FIG. 8, in the rotary machine 301 according to the present embodiment, the impeller 310 is fitted at the outside of the rotation shaft 5 by the shrink fitting in the same way as the rotary machine 1 of the above described first embodiment.

The impeller 310 is provided with an inner diameter portion 320, a disk portion 30, a plurality of blade portions 40, and a cover portion 50. The inner diameter portion 320 is fitted at the outside of the rotary shaft 5. The disk portion 30 is fitted at the outside of the inner diameter portion 320 and has a substantially disk-shape. The blade portions 40 are provided so as to protrude from a surface 30*a* of the one side in the direction of the axis O of this disk portion 30. The cover portion 50 is formed in a single-piece with respect to the blade portions 40, and is formed so as to cover the blade portions 40 from the one side in the direction of the axis O. In addition, the fixing portion 33 having the same thickness in the radial direction to the thick portion 322 is formed in the disk portion 30. The disk portion 30, the blade portions 40, and a cover portion 50 are configured as the same as the above described first embodiment, and thus, the detail description thereof is omitted.

The inner diameter portion 320 is provided with a thin portion 21 having substantially a cylindrical shape at the one side in the direction of the axis O. The inner diameter portion 320 is provided with an expanding diameter portion 23, which gradually expands in diameter toward the other side, at the further other side in the direction of the axis O of the thin portion 21. In the inner diameter portion 320, a thick portion 322 having sufficiently larger thickness than the thin portion 21 in the direction of the radial direction is formed at the further other side in the direction of the axis O on the expanding diameter portion 23. The thick portion 322 is provided with a mounting seating surface 322*a* formed along the outer circumferential surface of the rotation shaft 5.

In the thick portion 322, a cut portion 322*c* which is chamfered is formed between the mounting seating surface 322*a* and a surface 322*b* of the other side. By forming this cut portion 322*c*, the length of the mounting seating surface 322*a* in the direction of the axis O is shorter than an inner circumferential surface 33*b* of the fixing portion 33 of the disk portion 30. The thickness of an edge of the other side in the direction of the axis O of the thick portion 322 is set the same as the thickness 2T of the edge of the other side in the direction of the axis O of the fixing portion 33.

The disc portion 30 is fitted at the outside of the fixing portion 33 in the state of aligning an edge of the one side in the direction of the axis O with respect to the mounting seating surface 322*a* of the inner diameter portion 320. In addition, in FIG. 8, the chamfer shape of the cut portion 322*c* has a curved shape, but not limited to this shape.

Next, a deformation of the inner diameter portion 320 will be described with referring to FIGS. 9A to 9C.

Figure 9A:
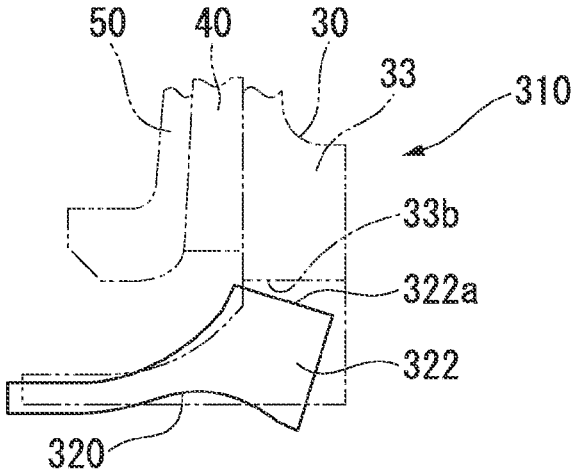
FIG. 9A is a view explaining a deformation of the inner diameter part of the impeller in the third embodiment of the present invention, and shows a case of not forming a cut portion.

FIG. 9A shows the case where the mounting seating surface 322*a* is extended toward the other side and the above described cut portion 322*c* is not formed. In addition, FIG. 9B shows the case where the thick portion 322 is not extended toward the other side than the mounting seating surface 322*a*. For convenience of description, each part corresponding to the parts of the inner diameter portion 320 of the present embodiment will be described with the same reference signs.

Figure 9B:
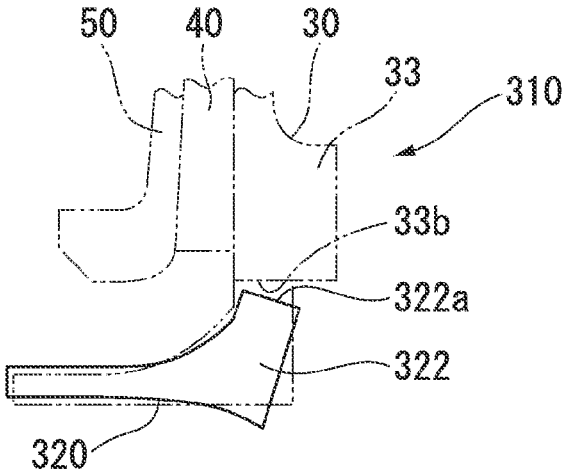
FIG. 9B is a view explaining a deformation of the inner diameter part of the impeller in the third embodiment of the present invention, and shows a case of not forming a thick part at the other side more than a mounting surface.

In the case of the shapes shown in FIGS. 9A and 9B, if the disk portion 30 is fitted to the inner diameter portion 320 by shrink fitting, a gap between the inner circumferential surface 33*b* and the mounting seating surface 322*a* is created at the other side in the direction of the axis O. Here, in the above impeller 310, the thickness of the thick portion 322 is larger than the thickness of the fixing portion 33 in the radial direction, and thus, the rigidity of the thick portion 322 is substantially constant along the direction of the axis O. Thus, in the thick portion 322, the deformation mode (the configuration of the deformation), which is occurred by the surface pressure applied from the disk portion 30, becomes to a deformation mode of bending deformation in which a base end of the bending is the thin portion 21 side.

That is, the thick portion 322 as a whole deforms so as to incline to the inner circumferential side with respect to the axis O toward the other side from the one side in the direction of the axis O of the thick portion 322, and the above gap is created. In addition, in FIGS. 9A and 9B, for convenience of description, the displacement of the inner diameter portion 20 is shown in an exaggerated way.

Figure 9C:
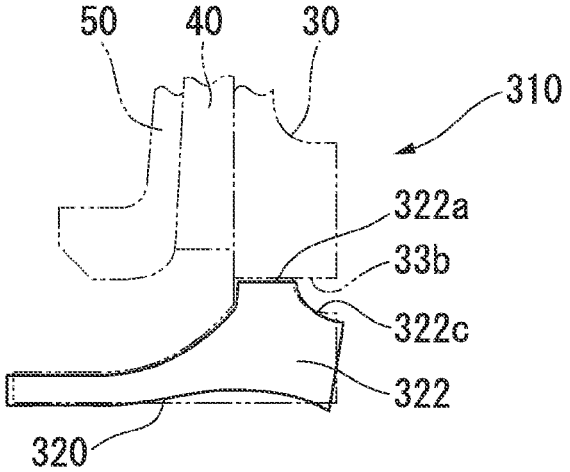
FIG. 9C is a view explaining a deformation of an inner diameter part of the impeller in the third embodiment of the present invention, and shows a case of the current embodiment.
Figure 10:
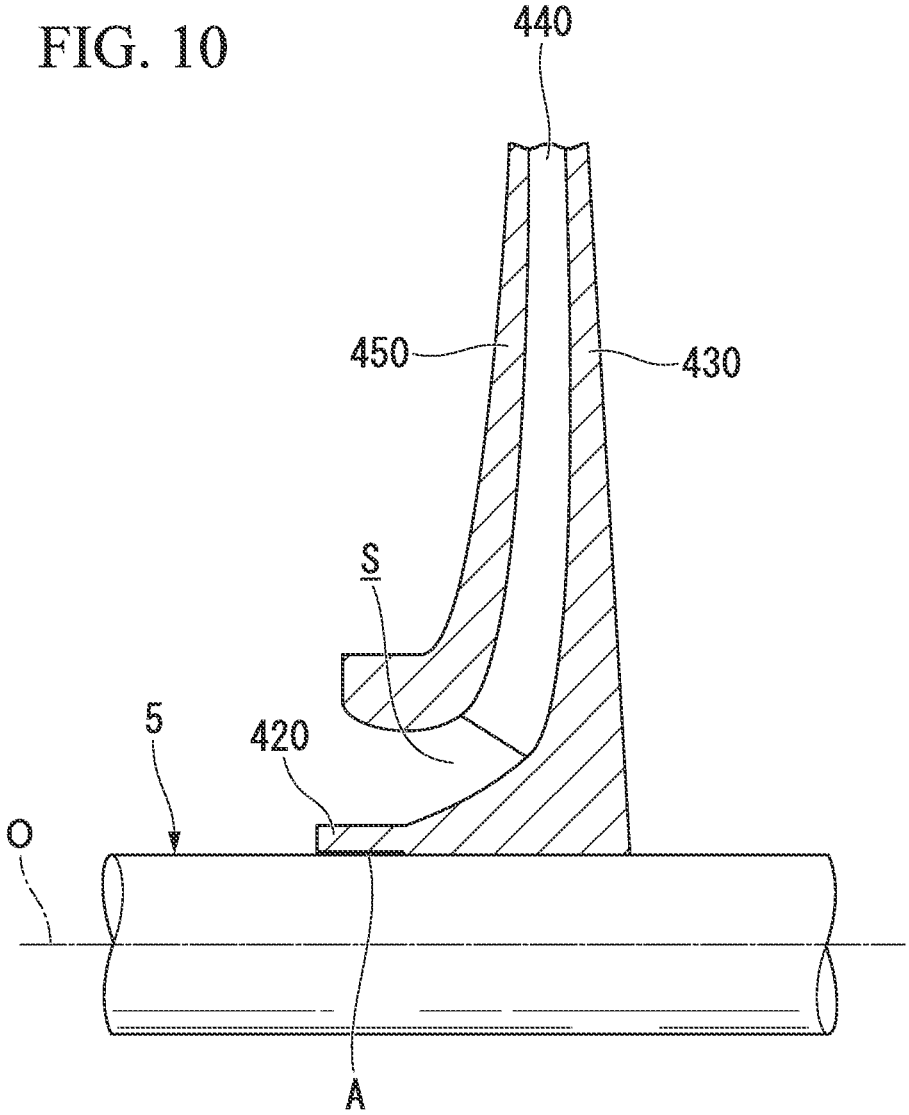
FIG. 10 is a vertical cross-sectional view of a first aspect of a conventional impeller.
Figure 11:
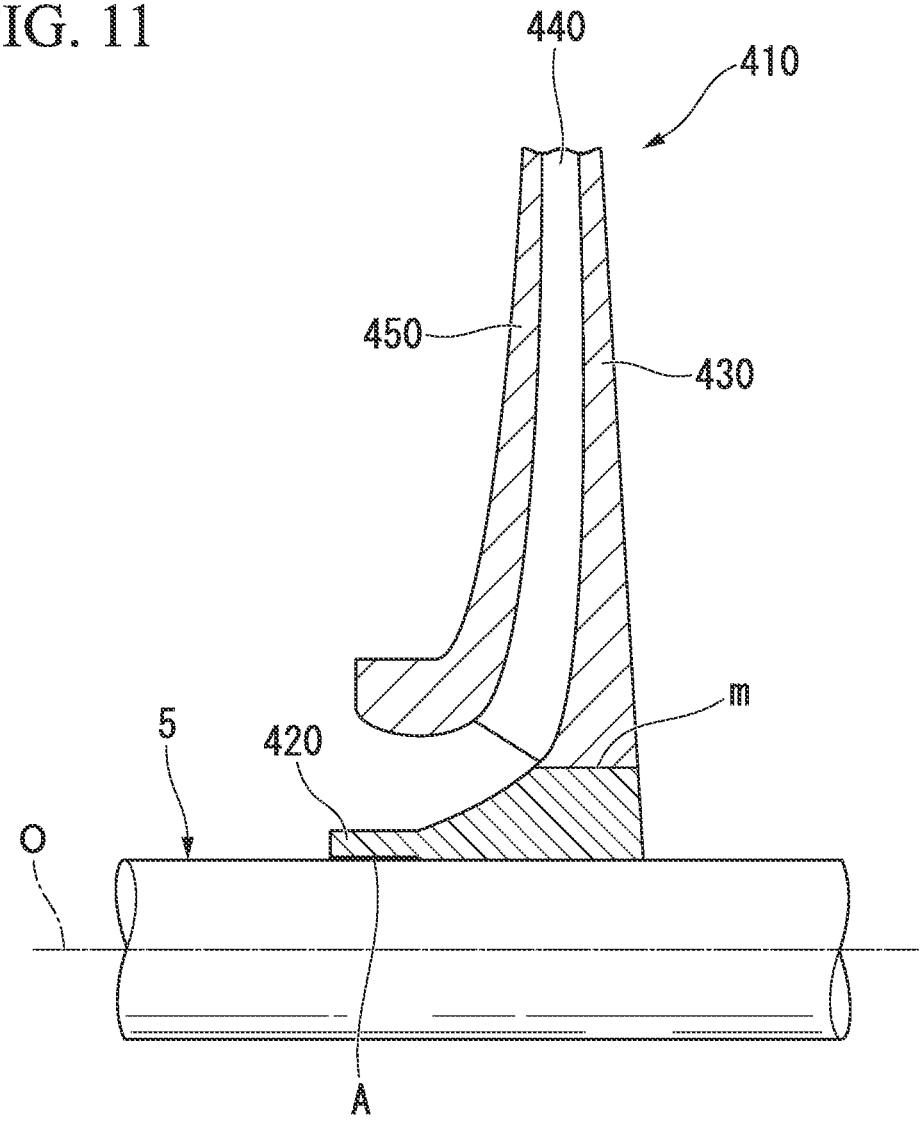
FIG. 11 is a vertical cross-sectional view of a second aspect of a conventional impeller.

On the other hand, in a case of the inner diameter portion 320 of the present embodiment shown in FIG. 9C, the thickness of the thick portion 322 in the cut portion 322*c* is smaller than the thickness of the fixing portion 33. That is, the thick portion 322 has a high rigidity area at the intermediated portion along the direction of the axis O and has low rigidity areas at both sides thereof. Thus, in the thick portion 322, the deformation mode, which is occurred by the surface pressure applied from the disk portion 30, becomes to a deformation mode, which deforms with bending toward the inner circumferential side at both sides of the thin portion 21 side and the cut portion 322*c* from the intermediated portion in the direction of the axis O. That is, the thick portion 322 as a whole does not deform disproportionately so as to incline toward any one of the sides with respect to the axis O. Thus, the mounting seating surface 322*a* is held in substantially in parallel with respect to the inner circumferential surface 33*b*.

Furthermore, the length in the direction of the axis O of the mounting seating surface 322*a* of the thick portion 322 is formed smaller than the length in the direction of the axis O of the inner circumferential surface 33*b* of the fixing portion 33, and thus, even if the inner circumferential surface 33*b* is bend at the time of the shrink fitting, the mounting seating surface 322*a* easily fits closely the inner circumferential surface 33*b*.

Therefore, according to the impeller 310 of the above described third embodiment and the rotary machine 301, even if the thickness in the radial direction of the fixing portion 33 and the thick portion 322 are set to be equivalent, by reducing the rigidity of the thick portion 322 partially by the cutting portion 322*c*, the mounting seating surface 322*a* and the inner circumferential surface 33*b* are kept in substantially parallel and can easily fit closely to each other. Therefore, the surface pressure by the shrink fitting can be sufficiently secured.

In addition, the present invention is not limited to the configuration of each above described embodiment, but design changes can be made without departing from the spirit thereof.

For example, keys or key grooves, which form a pair in the inner circumferential surface 33*b* of the fixing portion 33 and the mounting seating surface 22*a*, 322*a* of the thick portion 22, 322 in the above described embodiment and extend to the direction of the axis O, may be formed. According to this configuration, it is possible to perform easily the positioning in a circumferential direction of the impellers 10, 210, and 310.

In addition, in the each above described embodiment, a case in which the fitting the inner diameter portion 20 and the inner diameter portion 320 at the outside of the rotation shaft 5 and the fitting the disk portion 30 at the outside of the inner diameter portion 20 and the inner diameter portion 320 are performed by the shrink fitting are described, however, if thermal deformation is used for the fitting operation, the other fitting methods, for example, cooling fitting, and the like, can be adopted.

Furthermore, in each above embodiment, examples in which the rotary machine 1, 201, and 301 are applied to the centrifugal compressor 100 are described, but not limited to the centrifugal compressor 100. It is possible to apply to, for example, various industrial compressors, a turbo refrigerator, a small gas turbine.

FIELD OF INDUSTRIAL APPLICATION

According to the present invention, the degree of freedom in design is improved in the disk portion, the blade portion and the cover portion, and the disk portion, the blade portion and the cover portion can be formed in a single-piece easily. In addition, it is possible to prevent a gap from being created at the joining surface between the disk portion and the inner diameter portion caused by thermal deformation, and it is possible to assemble and disassemble easily with respect to the rotation shaft.

DESCRIPTION OF REFERENCE SIGNS

1, 201, 301: rotary machine
5: rotation shaft
20, 320: inner diameter portion
24: positioning portion
24*a*: surface of the one side
25: lightening portion
234: recessed portion
30: disk portion
32: main body portion
33: fixing portion
40: blade portion
50: cover portion
O: axis

The invention claimed is:

1. An impeller comprises:

an inner diameter portion, one side of which, in a direction of an axis of a rotation shaft of a rotary machine, is fitted at a radially outward side of the rotation shaft;

a disk portion fitted at a radially outward side of the inner diameter portion at another side in the direction of the axis;

a blade portion protruding from a surface facing toward the one side in the direction of the axis; and a cover portion formed in a single-piece together with the blade portion and the disk portion and covering the blade portion from the one side in the direction of the axis, wherein the inner diameter portion includes:

a thin portion formed at the one side in the direction of the axis, and fitted to the rotation shaft, a thick portion formed at the other side in the direction of the axis, and having a thickness which is thicker than the thin portion, and an expanding diameter portion formed between the thin portion and the thick portion, and having a diameter which expands gradually toward the other side in the direction of the axis, wherein an inner diameter of the expanding diameter portion and an inner diameter of the thick portion are formed so as to be larger than an outer diameter of the rotation shaft, wherein the disk portion includes:

a main body portion adjacent to the blade portion; and a fixing portion disposed at a radially inward side of the main body portion and fitted at a radially outward side of an outer peripheral surface of the thick portion, wherein the fixing portion protrudes from the main body portion toward the other side in the direction of the axis, wherein the inner diameter portion includes a positioning portion that allows positioning of the disk portion in the direction of the axis, and wherein the positioning portion includes a lightening portion at a contacting surface contacting a surface of the one side in the direction of the axis.

2. The impeller according to claim 1, wherein the fixing portion has a thickness in a radial direction of the rotation shaft which is larger than a thickness in the radial direction of the rotation shaft of the thick portion of the inner diameter portion.

3. The impeller according to claim 2, wherein a recessed portion having an annular shape is formed so as to be adjacent to the fixing portion at the other side in the direction of the axis.

4. An impeller comprises:

an inner diameter portion, one side of which, in a direction of an axis of a rotation shaft of a rotary machine, is fitted at a radially outward side of the rotation shaft;

a disk portion fitted at a radially outward side of the inner diameter portion at another side in the direction of the axis;

a blade portion protruding from a surface facing toward the one side in the direction of the axis; and a cover portion formed in a single-piece together with the blade portion and the disk portion and covering the blade portion from the one side in the direction of the axis, wherein the inner diameter portion includes:

a thin portion formed at the one side in the direction of the axis, and fitted to the rotation shaft, a thick portion formed at the other side in the direction of the axis, and having a thickness which is thicker than the thin portion, and an expanding diameter portion formed between the thin portion and the thick portion, and having a diameter which expands gradually toward the other side in the direction of the axis, wherein an inner diameter of the expanding diameter portion and an inner diameter of the thick portion are formed so as to be larger than an outer diameter of the rotation shaft, wherein the disk portion includes:

a main body portion adjacent to the blade portion; and a fixing portion disposed at a radially inward side of the main body portion and fitted at a radially outward side of an outer peripheral surface of the thick portion, wherein the fixing portion protrudes from the main body portion toward the other side in the direction of the axis, and wherein the thick portion has a cutting portion, which is chamfered, at the other side in the direction of the axis, and at the outer peripheral surface of the thick portion.

* * * * *